US007248241B2

(12) United States Patent
Chen et al.

(10) Patent No.: US 7,248,241 B2
(45) Date of Patent: Jul. 24, 2007

(54) METHOD AND APPARATUS FOR DYNAMIC GRAY LEVEL SWITCHING

(75) Inventors: Li-Yi Chen, Nantou Hsien (TW); Tean-Sen Jen, Taoyuan Hsien (TW)

(73) Assignee: Hannstar Display Corp., Taipei (TW)

( * ) Notice: Subject to any disclaimer, the term of this patent is extended or adjusted under 35 U.S.C. 154(b) by 758 days.

(21) Appl. No.: 10/618,820

(22) Filed: Jul. 15, 2003

(65) Prior Publication Data

US 2004/0027322 A1 Feb. 12, 2004

Related U.S. Application Data

(63) Continuation-in-part of application No. 09/661,289, filed on Sep. 13, 2000, now abandoned.

(30) Foreign Application Priority Data

Aug. 1, 2000 (TW) ..... 89115420 A

(51) Int. Cl.
*G09G 3/36* (2006.01)

(52) U.S. Cl. ..... 345/89

(58) Field of Classification Search ..... 345/87–93, 345/94, 84, 55
See application file for complete search history.

(56) References Cited

U.S. PATENT DOCUMENTS

| | | | | |
|---|---|---|---|---|
| 4,864,290 | A * | 9/1989 | Waters | 345/89 |
| 5,089,812 | A * | 2/1992 | Fuse et al. | 345/89 |
| 5,347,294 | A * | 9/1994 | Usui et al. | 345/89 |
| 5,956,014 | A * | 9/1999 | Kuriyama et al. | 345/690 |
| 6,054,971 | A | 4/2000 | Okada et al. | |
| 6,320,562 | B1 * | 11/2001 | Ueno et al. | 345/89 |
| 2004/0189568 | A1 * | 9/2004 | Lee et al. | 345/89 |

* cited by examiner

*Primary Examiner*—Vijay Shankar
*Assistant Examiner*—Steven Holton
(74) *Attorney, Agent, or Firm*—Birch, Stewart, Kolasch & Birch, LLP

(57) ABSTRACT

A method and apparatus for gray level dynamic switching. The method is applied to driving a display with at least one pixel. In the method of the present invention, a gray level sequence $S_G$ is provided. $S_G$ sequentially represents two or more desired gray levels $G_o(1), \ldots, G_o(T)$ of the pixel at consecutive time frames 1, . . . , T and comprises a current gray level $G_o(t)$ and a previous gray level $G_o(t-1)$ corresponding to time frames t and t−1, respectively. Then, the pixel is driven with an optimized driving force $V_d(t)$ to change the pixel forward to a state corresponding to $G_o(t)$ according to $G_o(t)$ and $G_o(t-1)$. In the present invention, the optimized driving voltage $V_d(t)$ is determined by equations of $V_d(t)=V_o(t-1)+ODV$ and $V_d(t)=a\times G_d(m)^3+b\times G_d(m)^2+c\times G_d(m)+d$, wherein the voltage ODV is a minimum voltage capable of obtaining one gray level transition in a determined response time.

18 Claims, 5 Drawing Sheets

| | 0 | 1 | 2 | 3 | 4 | 5 | 6 | 7 |
|---|---|---|---|---|---|---|---|---|
| 0 | 0 | 3 | 4 | 5 | 6 | 6 | 7 | 7 |
| 1 | 0 | 1 | 4 | 5 | 6 | 6 | 7 | 7 |
| 2 | 0 | 0 | 2 | 5 | 6 | 6 | 7 | 7 |
| 3 | 0 | 0 | 0 | 3 | 6 | 6 | 7 | 7 |
| 4 | 0 | 0 | 0 | 1 | 4 | 6 | 7 | 7 |
| 5 | 0 | 0 | 0 | 1 | 2 | 5 | 7 | 7 |
| 6 | 0 | 0 | 0 | 1 | 2 | 4 | 6 | 7 |
| 7 | 0 | 0 | 0 | 1 | 2 | 4 | 4 | 7 |

METHOD AND APPARATUS FOR DYNAMIC GRAY LEVEL SWITCHING

This application is a continuation-in-part of application Ser. No. 09/661,289 filed on Sep. 13, 2000 now abandoned, the entire contents of which are hereby incorporated by reference and for which priority is claimed under 35 U.S.C. § 120.

BACKGROUND OF THE INVENTION

1. Field of the Invention

The present invention-generally relates to a method and apparatus for switching the gray levels of a pixel in a liquid crystal display (LCD).

2. Description of the Related Art

While there are-several types of liquid crystal displays (LCDs), all LCDs operate on the same general principle. A liquid crystal material is placed in a sealed but light transmissive chamber and light transmissive electrodes are placed above and below the liquid crystal material. In one type of LCD utilizing what are called twisted nematic liquid crystals, when sufficient electric potential is applied between the electrodes, the liquid crystal molecules change their alignment. The change in alignment alters the polarization of light passing through the liquid crystal material. The chamber or cell essentially acts as a light shutter or valve, letting either a maximum, minimum, or intermediate levels of light through. These levels of light transmittance are called gray levels.

A matrix LCD structure is normally utilized for complex displays. A large number of very small independent regions, of liquid crystal material are positioned in a plane. Each of these regions is generally called a picture element or pixel. These pixels are usually arranged in rows and columns forming a matrix. Corresponding numbers of column and row electrodes are correlated with the rows and columns of pixels. An electric potential, also called a driving force, can therefore be applied to any pixel by selection of appropriate row and column electrodes and a desired graphic can be generated.

The amplitude of a driving force for a pixel depends on the gray level the pixel is going to present. FIG. 1 is a relational diagram between the light transmittance of a liquid crystal material and the driving voltage. Digitized by 3 bits, for example, the light, transmittance is represented by 8 gray levels, $G_0$ to $G_7$. Through the oblique line in FIG. 1, 8 driving forces, $V_0$ to $V_7$, for driving the liquid crystal material to respectively present the 8 gray levels under a static condition, can be determined. The conventional method for driving a pixel is to provide a driving force without consideration of dynamic switching. That is, if a pixel driver consecutively receives signals of gray level in a sequence of [$G_2$, $G_0$, $G_4$, $G_5$], for example, it consecutively provides the respective static driving voltages in a sequence of [$V_2$, $V_0$, $V_4$, $V_5$] to the pixel.

However, under dynamic conditions, the response rate for a liquid crystal material to change its light transmittance depends on the difference between the desired gray levels of the liquid crystal material in the previous and the current time frames. The smaller the difference the poorer the response rate. In other words, the switch between all-black and all-white is faster than a switch between intermediate levels. This results in bad graphic quality when an LCD displays highly dynamic pictures. Furthermore, the response rate also limits the maximum switching rate between picture frames and limits the application of an LCD for displaying TV programs. As shown in FIG. 2, when the response rate for gray level switching (the dash line in FIG. 2) is far behind the switch rate of the driving voltages (the solid line in FIG. 2), the pixel cannot present the current gray level.

SUMMARY OF THE INVENTION

Therefore, an object of the present invention is to provide a method and apparatus for increasing the-response rates of gray level switching to improve the dynamic image quality of LCD displays.

The present invention achieves the above-indicated object by providing a method for gray level dynamic switching. This method is applied to driving a display with a pixel. The method comprises a step of providing a gray level sequence $S_G$. $S_G$ sequentially represents two or more gray levels $G_o(1), \ldots, G_o(T)$ representing the desired gray levels of the pixel at consecutive time frames 1, . . . , T and comprises an current gray level $G_o(t)$ and a previous gray level $G_o(t-1)$ corresponding to time frames t and t−1, respectively.

In the method of the present invention, an optimized driving voltage $V_d(t)$ is determined, according to an equation $V_d(t)=V_o(t-1)+ODV$, wherein the ODV is a minimum voltage capable of obtaining one gray level transition in a determined response time. A dynamic gray level data $G_d(t)$ is then determined according to an equation $$V_d(t)=a\times Gd(t)^3+b\times Gd(t)^2+c\times Gd(t)+d,$$

wherein a is −0.0004, b is 0.0037, c is −0.1443, and d is 8.6992. Next, the optimized driving voltage $V_d(t)$ is produced according to the dynamic gray level data $G_d(t)$. Finally, the pixel is driven with the optimized driving voltage $V_d(t)$ to change the pixel forward to a state corresponding to $G_o(t)$.

Another aspect of the present invention provides an apparatus for gray level dynamic switching applied to drive a display with a pixel. The apparatus-comprises a memory set, a processor and a driving circuit. The memory set stores a previous gray level $G_o(t-1)$ that represents the desired gray level of the pixel at time frame t−1. The processor determines an over-driving voltage $V_d(t)$ according to a current gray level $G_o(t)$ and an equation $$V_d(t)=V_o(t-1)+ODV,$$

and determines a dynamic gray level data $G_d(t)$ according to an equation $$V_d(t)=a\times Gd(t)^3+b\times Gd(t)^2+c\times Gd(t)+d$$

wherein $G_o(t)$ represents the desired level of the pixel at time frame t, the voltage ODV is a minimum voltage capable of obtaining one gray level transition in a determined response time, a is −0.0004, b is 0.0037, c is −0.1443, and d is 8.6992. The driving circuit receives $G_d(t)$ and correspondingly generates the optimized driving voltage $V_d(t)$ to drive the pixel to change the pixel forward to a current state corresponding to $G_o(t)$.

Another aspect of the present invention provides a display system comprising a display, a memory, and a processor. The display has at least one pixel. The memory stores a program. According to the program in the memory, the processor receives an original gray level sequence $S_o$ consisting of two or more original gray levels $G_o(1), \ldots, G_o(T)$ The processor then transforms $S^o$ to an adjusted gray level sequence $S_d$ consisting of two or more adjusted gray levels $G_d(1), \ldots, G_d(M)$ an adjusted gray level $G_d(m)$ being generated according to a relevant sub-sequence comprising $G_o(t-1)$ and $G_o(t)$. In this case, an optimized driving voltage $V_d(t)$ is determined according to $G_o(t)$ and an equation $$V_d(t)=V_o(t-1)+ODV,$$

and the adjusted gray level $G_d(m)$ is determined according to an equation $$V_d(t)=a\times G_d(m)^3+b\times G_d(m)^2+c\times G_d(m)+d,$$

where in the voltage ODV is a minimum voltage capable of obtaining one gray level transition in a determined response time, a is −0.0004, b is 0.0037, c is −0.1443, and d is 8.6992. Next, the processor sequentially drives the pixel with driving forces corresponding to $G_d(1), \ldots, G_d(M)$ in $S_d$.

The advantage of the present invention is increased response rate of the gray level switching. Since the driving force for the current time frame is-not decided by only the current gray level but also by the previous gray level, an optimized driving force with enlarged voltage difference can be generated to increase the response rate of gray level switching.

BRIEF DESCRIPTION OF THE DRAWINGS

The present invention can be more fully understood by reading the subsequent-detailed description and examples with reference made to the accompanying drawings, wherein.

DETAILED DESCRIPTION OF THE INVENTION

In the present invention, the driving force for a-time frame depends on not only the desired gray level of a pixel in the current time frame, but also on the desired gray level of the pixel in the previous time frame. In this manner, an optimized driving force can be determined, allowing the transmittance of the pixel in a dynamic switching situation to switch to the desired gray level within a single time frame. It is understood, however, that the present invention is not limited to referencing back only one time frame to generate an optimized driving force. In fact, the present invention can reference back one, two, or more frames to generate an optimized driving force which can achieve a desired gray level for a pixel in a single driving period.

In the following embodiments, eight gray levels $G_0$ to $G_7$, respectively corresponding to eight driving voltages $V_0$ to $V_7$, are used as an example. It understood, however, that any number of gray levels can be used to define the transmittance status.

Generally speaking, switching between two adjacent gray levels has the slowest response rate. Thus, an example of switching from $G_3$ to $G_4$ is described in the following paragraph.

In the prior art, when the transmittance of a pixel changes from $G_3$ to $G_4$, the voltage for driving the pixel changes from $V_3$ to $V_4$. If $V_4-V_3$ equals −0.2 volt, the period of one time frame equals 33 ms. As mentioned in the background, the voltage difference of −0.2 volt cannot change the transmittance status of the pixel from $G_3$ to $G_4$ within one time frame. However, by calculation or experiment, the voltage difference for switching the transmittance status from $G_3$ to $G_4$ within one time frame can be found to be −0.4 volt. Thus, the invention chooses an optimized driving voltage of $V_3-0.4$ to drive the pixel in the current time frame, thereby improving the response rate of the gray level switching.

In other words, if the voltage difference is not large enough to drive a pixel to switch to the current gray level as in the prior art, the present invention utilizes an optimized driving voltage-with a larger and more suitable voltage difference to drive the pixel. Thus, the response rate for gray level switching can be increased.

Figure 1:
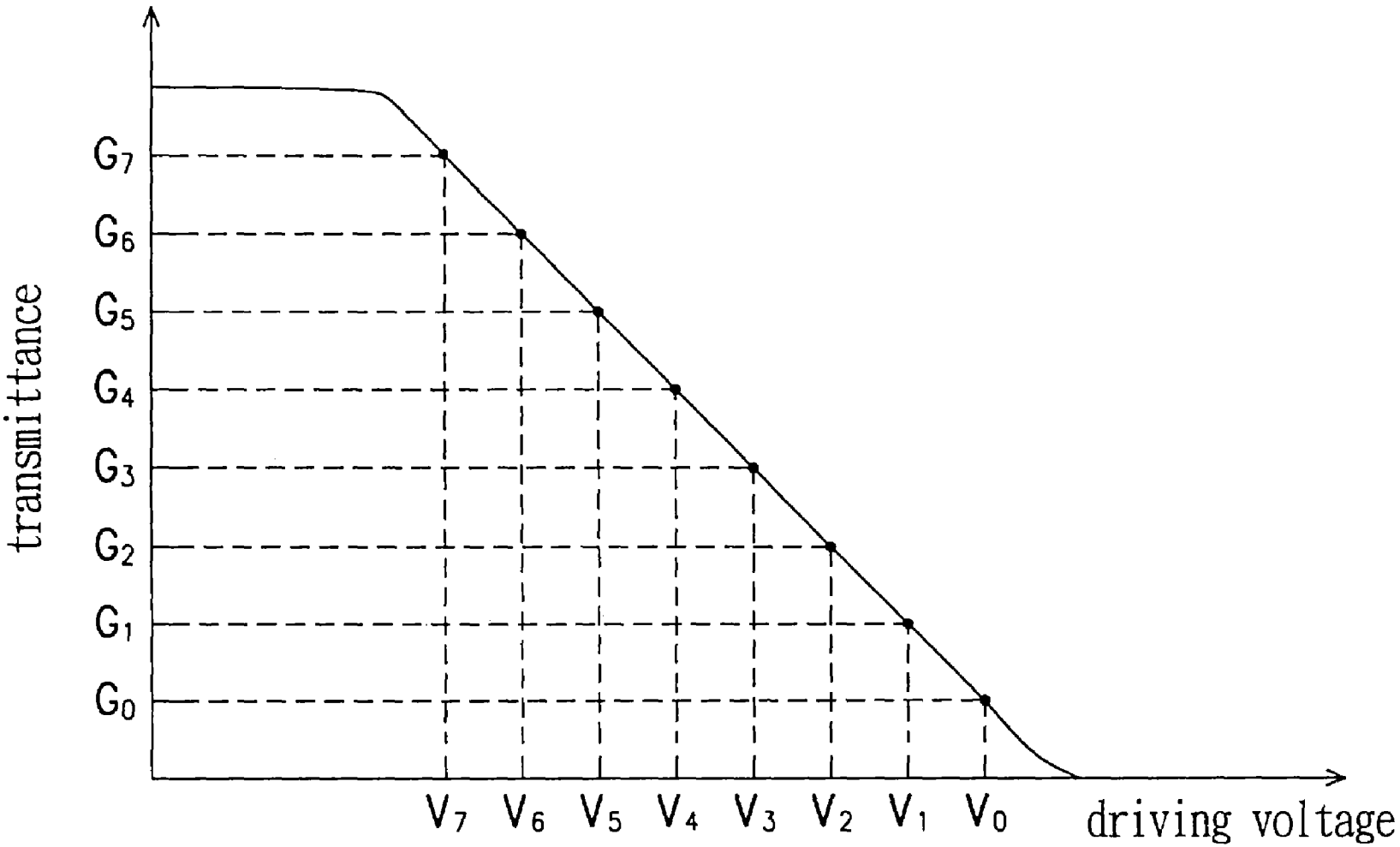
FIG. 1 (PRIOR ART)
FIG. 1 is a relational diagram between the light transmittance of a liquid crystal material and the driving voltage.

Obviously, whether $V_3$ is larger or smaller than $V_4$ depends upon the property of optic-to-electric curve for a pixel, as shown in FIG. 1. Different material used for a pixel may cause very different optic-to-electric curves.

FIRST EMBODIMENT

Figure 3:
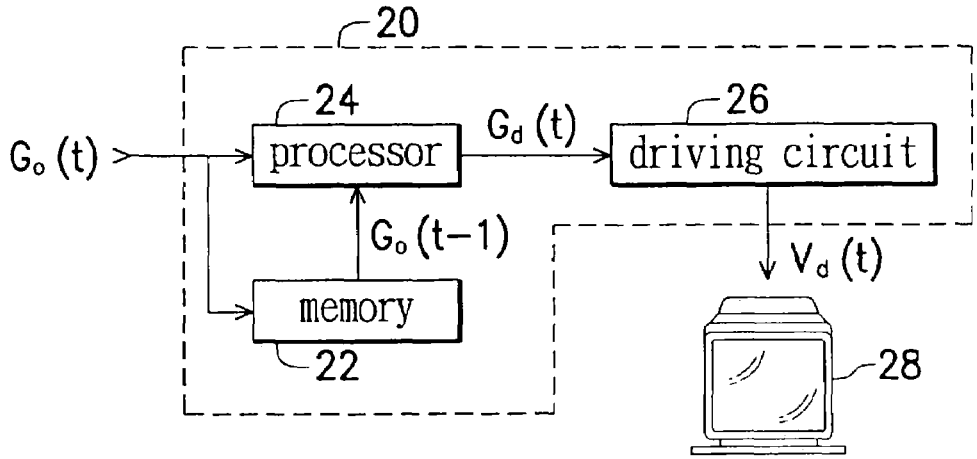
FIG. 3 illustrates a driving chip connected to an LCD.

FIG. 3 illustrates a driving chip connected to an LCD. A driving chip 20 consecutively receives a current gray level $G_o(t)$ and provides an optimized driving voltage $V_d(t)$ to drive a pixel in LCD 28, thereby making it possible for the pixel to switch its status forward to $G_o(t)$ within a single time frame. Driving chip 20 has a memory 22, a processor 24 and a driving circuit 26. Memory 22, such as a dynamic random access memory (DRAM), records a previous gray level $G_o(t-1)$, for example, the desired gray level of the previous time frame. Processor 24 generates an adjusted gray level $G_d(t)$ according to $G_o(t-1)$ and $G_o(t)$. Driving circuit 26 receives $G_d(t)$ and outputs a responding optimized driving force $V_d(t)$ to drive the pixel, thus switching the transmittance of the pixel.

Figure 4:
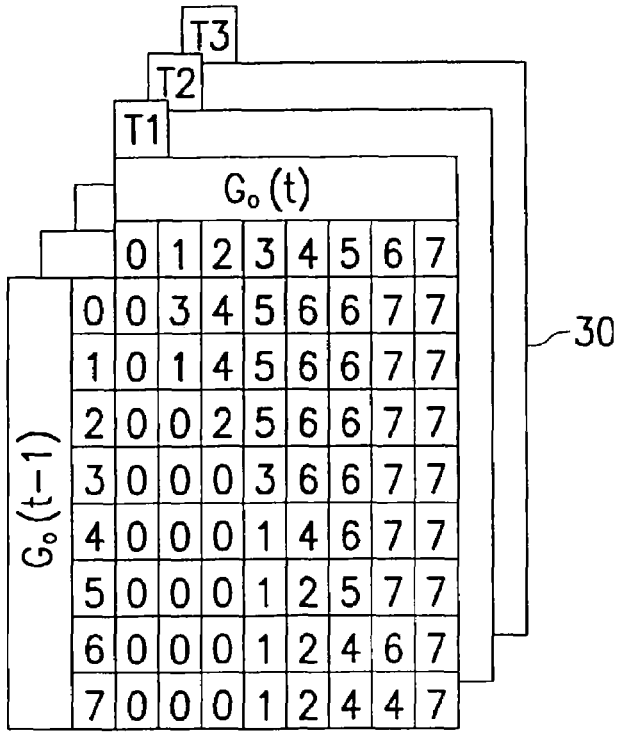
FIG. 4 shows a look-up table according to the present invention.

A look-up table 30 shown in FIG. 4 can be used to generate $V^d(t)$. Look-up table 30 can be created by experiment or calculation. For example, if the previous gray level $G_o(t-1)$ and the current gray level $G_o(t)$ are respectively equal to $G_3$ and $G_4$, according to look-up table 30, driving circuit 26 should output a driving force of $V_6$ to drive the pixel. Temperature compensation can also be added in look-up table 30. Conventionally, the response rate for gray level switching increases as the operating temperature of liquid crystal materials increases, and vice versa. Therefore, look-up table 30 has several sub-tables for different temperatures T1, T2, T3, etc. Processor 24 can select one sub-table according to the operating temperature to determine an appropriate driving voltage for the next time frame.

Processor 24 can also utilize mathematical calculations or logical operations to generate the appropriate driving voltage. For example, utilizing an equation in processor 24 with variables of $G_o(t)$ and $G_o(t-1)$, the optimized driving voltage can be obtained. Of course, the equation can also include a temperature variable to achieve the function of temperature compensation as mentioned in the last paragraph.

In this case of the present invention, a current gray level $G_o(t)$ and a previous gray level $G_o(t-1)$ correspond to time frames n and n−1 respectively. $G_o(t)$ corresponds to a driving voltage $V_o(t)$ to present $G_o(t)$ under a static condition. The $G_o(t-1)$ corresponds to a driving voltage $V_o(t-1)$ to present $G_o(t-1)$ under a static condition also. The relationship of the driving voltages $V_o(t-1)$ and $V_o(t)$ and the gray levels $G_o(t-1)$ and $G_o(t)$ are a gamma curve. The microprocessor can obtain the driving voltages $V_o(t-1)$ and $V_o(t)$ both according to equation 1.

$$V_o(t)=a\times G_o(t)^3+b\times G_o(t)^2+c\times G_o(t)+d \quad (1)$$

Wherein a is −0.0004, b is 0.0037, c is −0.1443, and d is 8.6992.

Next, the processor 24 determines an optimized driving voltage $V_d(t)$ according to the current gray level $G_o(t)$ and the previous gray level $G_o(t-1)$; and an equation 2.

$$V_d(t)=V_o(t-1)+ODV \quad (2)$$

Generally, switching between two adjacent gray levels has the slowest response rate. Gray-to-gray as set as 16 ms is target specification, and each type of liquid crystal has the minimum voltage ODV, for example 0.6V, to meet the target specification. Namely, the voltage ODV is a minimum voltage capable of obtaining one gray level transition in a determined response time.

Further, the polarity of the voltage ODV is determined according to the current gray level $G_o(t)$ and the previous gray level $G_o(t-1)$. For example, in positive frame, the polarity of the ODV is positive when $G_o(t)>G_o(t-1)$ and the polarity of the ODV is negative when $G_o(t)<G_o(t-1)$. Additionally, in negative frame, the polarity of the voltage ODV is negative when $G_o(t)>G_o(t-1)$ and positive when $G_o(t)<G_o(t-1)$.

The processor 24 then determines a dynamic gray level data $G_d(t)$ according to the equation 1 and the optimized driving voltage $V_d(t)$.

That is, $V_d(t)=a\times G_d(t)^3+b\times G_d(t)^2+c\times G_d(t)+d$, wherein the value and polarity of the voltage ODV are known as mentioned above, for example −0.6 V, a is −0.0004, b is 0.0037, c is −0.1443, and d is 8.6992. Thus, $G_d(n)$ can be obtained.

Next, the driving circuit 26 produces the optimized driving voltage $V_d(t)$ according to the dynamic gray level data $G_d(t)$, and drives the pixel with the optimized driving voltage $V_d(t)$ to change the pixel forward to a state corresponding to $G_o(t)$.

Typically, the response rate for gray level switching increases as the operating temperature of liquid crystal materials increases, and vice versa. Therefore, the voltage ODV can be adjusted according to an operating temperature, and further the dynamic gray level data $G_d(t)$ and the optimized driving voltage $V_d(t)$ can be adjusted for temperature compensation. In the present invention, the voltage ODV is inversely proportional to the operating temperature. That is, the voltage ODV and the optimized driving voltage $V_d(t)$ are lowered when the operating temperature increases, and vice versa.

SECOND EMBODIMENT

Figure 5:
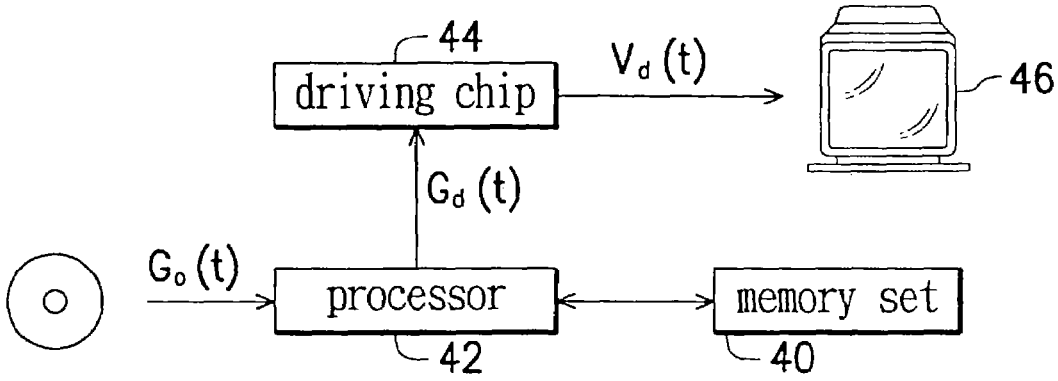
FIG. 5 shows a display system according to the present invention.
Figure 6:
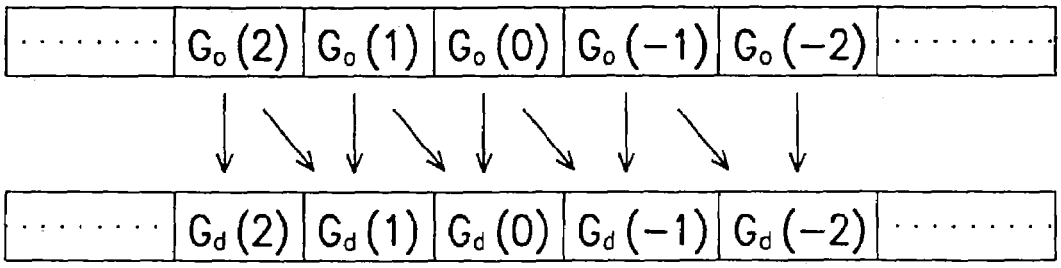
FIG. 6 shows the relationship between the adjusted gray level $G_d(t)$ and the original gray level, $G_o(t)$.

In order to save the cost of designing and purchasing a new driving chip having the functions described in the first embodiment, the present invention can be executed by software, such as adding a function of response rate compensation for gray level switching to a video display program. FIG. 5 shows a display system according to the present invention. The video display program is stored in the memory set 40. The processor 42 executes the instructions demanded by the video display program. Once the function of the response rate compensation for gray level switching is selected, the current gray level $G_o(t)$ is consecutively transformed by processor 42 to generate the adjusted gray level $G_d(t)$. The transformation is similar to that taught in the first embodiment. A look-up table, logic operation, or mathematical calculation can be used to generate the adjusted gray level $G_d(t)$ with references of $G_o(t)$ and $G_o(t-1)$. FIG. 6 shows the relationship between the adjusted gray level $G_d(t)$ and the current gray level $G_o(t)$. $G_d(-2)$ is generated according to $G_o(-2)$ and $G_o(-1)$, $G_d(-1)$ is generated according to $G_o(-1)$ and $G_o(0)$, and so on.

For example, according to the program in the memory set 40, the processor 42 executes the following steps. The processor 42 receives an original gray level sequence $S_o$ consisting of two or more original gray levels $G_o(1), \ldots, G_o(t)$, wherein a current gray level $G_o(t)$ and a previous gray level $G_o(t-1)$ correspond to time frames t and t−1, respectively. $G_o(t-1)$ corresponds to a driving voltage $V_o(t-1)$ to present $G_o(t-1)$ under a static condition.

The processor 42 then transforms the original gray level sequence $S_o$ to an adjusted gray level sequence $S_d$ consisting of two or more adjusted gray levels $G_d(1), \ldots, G_d(T)$, wherein an adjusted gray level $G_d(t)$ is generated according to a relevant sub-sequence comprising $G_o(t-1)$ and $G_o(t)$ In this case, the processor 42 determines an optimized driving voltage $V_d(t)$ according to the current gray level $G_o(t)$ and the previous gray level $G_o(t-1)$, and an equation of $$V_d(t)=V_o(t-1)+ODV.$$

At this time, the voltage ODV is a minimum voltage capable of obtaining one gray level transition in a determined response time. Further, the polarity of the voltage ODV is determined according to the current gray level $G_o(t)$ and the previous gray level $G_o(t-1)$. For example, in positive frame, the polarity of the ODV is positive when $G_o(t)>G_o(t-1)$ and the polarity of the ODV is negative when $G_o(t)<G_o(t-1)$ Additionally, in negative frame, the polarity of the voltage ODV is negative when $G_o(t)>G_o(t-1)$ and positive when $G_o(t)<G_o(t-1)$ The processor 42 then determines the adjusted gray level $G_d(t)$ according to an equation of $$V_d(t)=a\times G_d(t)^3+b\times G_d(t)^2+c\times G_d(t)+d,$$

a is −0.0004, b is 0.0037, c is −0.1443, and d is 8.6992. The driving chip 44 receives $G_d(t)$ and outputs a corresponding optimized driving voltage $V_d(t)$. Thus, a conventional driving chip can still be used to achieve the goal of the present invention. Therefore, the voltage ODV can be adjusted according to an operating temperature, and further, the dynamic gray level data $G_d(t)$ and the optimized driving voltage $V_d(t)$ can be adjusted for temperature compensation. In the present invention, the voltage ODV is inversely proportional to, the operating temperature. That is, the voltage ODV and the optimized driving voltage $V_d(t)$ are lowered when the operating temperature increases, and vice versa.

If $G_d(t)$ is not sent to the driving chip 44 immediately when generated by the processor 42, $G_d(t)$ can be stored in a temporary file. In other words, if an original video file has a gray level sequence composed of original gray levels $G_o(1), \ldots, G_o(t)$, another video file with a new gray level sequence composed of adjusted levels $G_d(1), \ldots, G_d(T)$ can be created. Then, even if the conventional video display program does not have the function of response rate compensation for gray level switching, it can execute the newly created video file to enhance the response rate of gray level switching.

Figure 2:
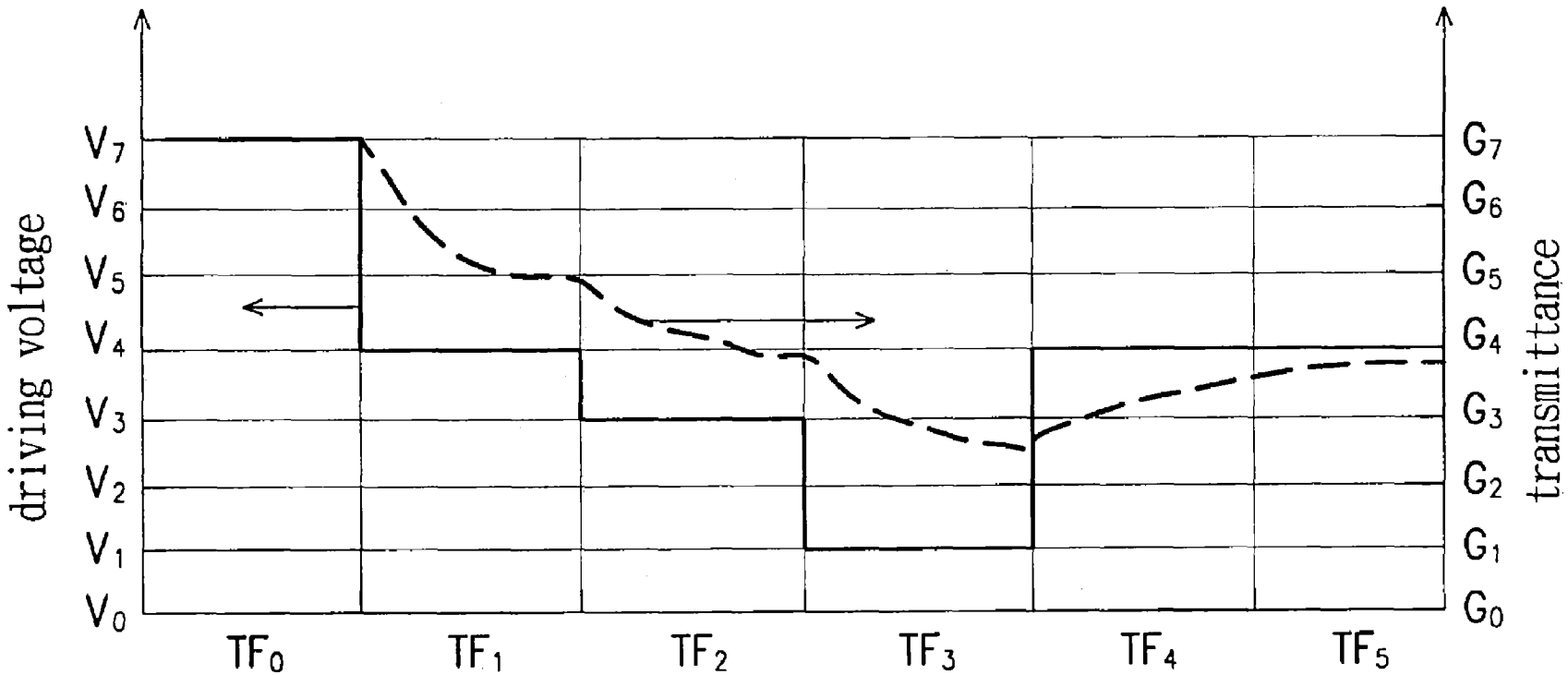
FIG. 2 (PRIOR ART)
FIG. 2 illustrates the performance of gray level switching according to the prior art.
Figure 7:
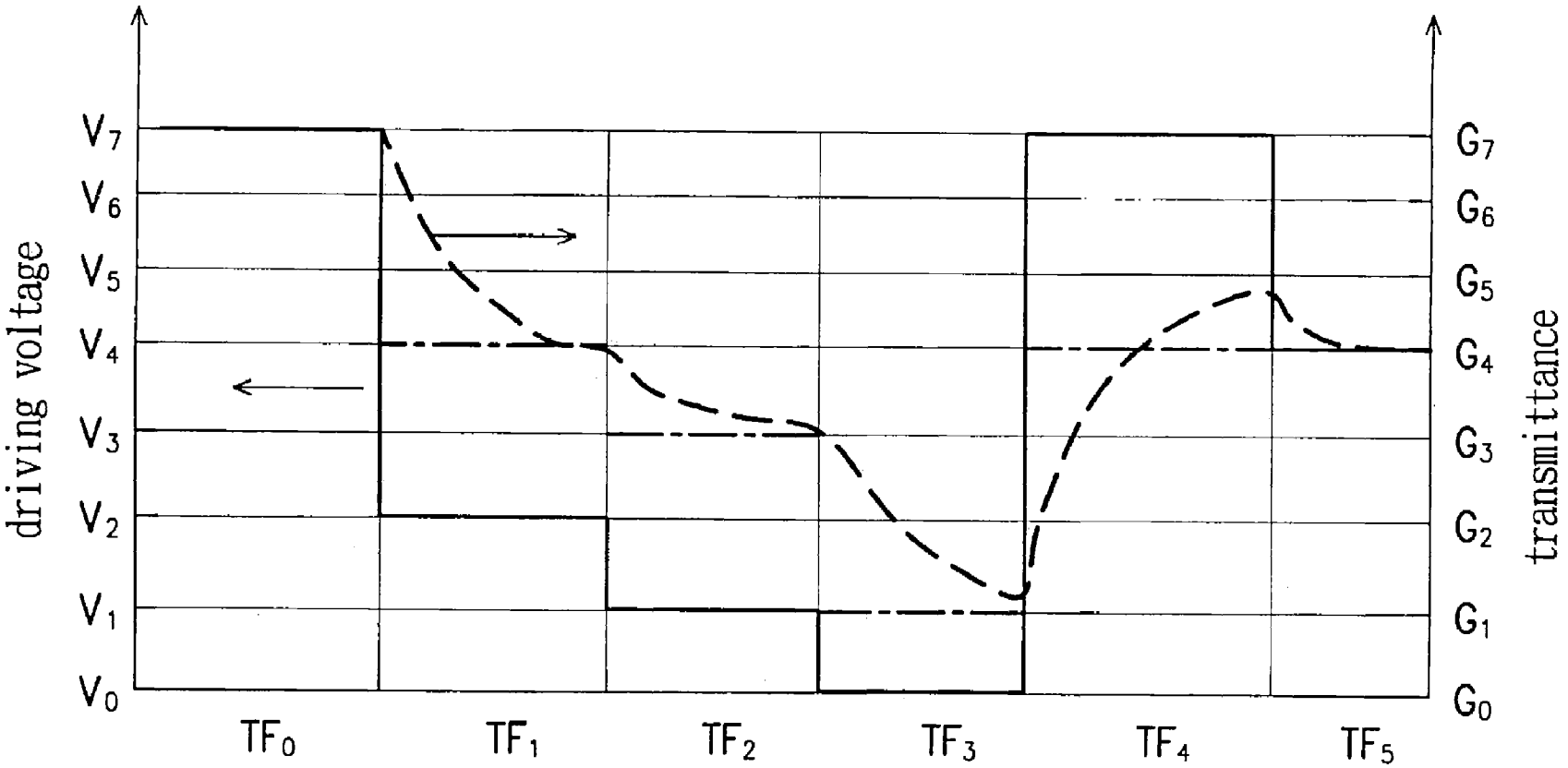
FIG. 7 illustrates the performance of gray level switching according to the present invention.

The performance of gray level switching according to the present invention is shown in FIG. 7. For comparison with the prior art, the gray levels corresponding to the driving voltages in time frames $TF_0$ to $TF_5$ shown in FIG. 2 serve as the original gray levels. Thus original gray levels of $G_7$, $G_4$, $G_3$, $G_1$, $G_4$ and $G_4$ construct the input sequence for the time period from $TF_0$ to $TF_5$. By referencing the look-up table in FIG. 4, the output sequence for the time period from $TF_0$ to $TF_5$ composes the adjusted gray levels of $G_7$, $G_2$, $G_1$, $G_0$, $G_7$ and $G_4$. Thus, the driving voltages for $TF_0$ to $TF_5$ are $V_7$, $V_2$, $V_1$, $V_0$, $V_7$ and $V_4$, respectively, are shown by the solid line in FIG. 7. The dashed line in FIG. 7 illustrates the variation of the transmittance of a pixel along with the driving forces according to the present invention. By comparing the results in FIGS. 2 and 7, it is obvious that increasing the driving voltage difference according to the present invention allows the pixel to better approach the desired gray level.

In addition to $G_o(t)$ and $G_o(t-1)$, earlier data, such as $G_o(t-2)$, also can serve as a reference to generate $G_d(t)$. Even $G_o(t-3)$ can serve as an input variable for generating a respective $G_d(t)$. The embodiment of the invention for generating $G_d(t)$ with reference to only $G_o(t)$ and $G_o(t-1)$ is an example, and is not intended to constrain the application of this invention.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A method for gray level dynamic switching, applied to a display with a pixel, comprising the following steps:

providing a gray level sequence SG, wherein SG sequentially represents two or more desired gray levels $G_o(1), \ldots, G_o(T)$ of the pixel at consecutive time frames $1, \ldots, T$ and comprises a current gray level $G_o(t)$ and a previous gray level $G_o(t-1)$ corresponding to time frames t and t−1, respectively, and $G_o(t)$ corresponds to a driving voltage $V_o(t)$ to present $G_o(t)$ under a static condition; and determining an optimized driving voltage $V_d(t)$, according to an equation $$V_d(t)=V_o(t-1)+ODV,$$

wherein the ODV is a minimum voltage capable of obtaining one gray level transition in a determined response time;

determining a dynamic gray level data $G_d(t)$ according to an equation $$V_d(t)=a\times G_d(t)^3+b\times G_d(t)^2+c\times G_d(t)+d;$$

producing the optimized driving voltage $V_d(t)$ according to the dynamic gray level data $G_d(t)$;

driving the pixel with the optimized driving voltage $V_d(t)$ to change the pixel forward to a state corresponding to $G_o(t)$.

2. The method as claimed in claim 1, wherein a is −0.0004, b is 0.0.0037, c is −0.1443, and d is 8.6992.

3. The-method as claimed in claim 1, wherein, in positive frame, the polarity of the voltage ODV is positive when $G_o(t)>G_o(t-1)$ and negative when $G_o(t)<G_o(t-1)$.

4. The method as claimed in claim 1, wherein, in negative frame, the polarity of the voltage ODV is negative when $G_o(t)>G_o(t-1)$ and positive when $G_o(t)<G_o(t-1)$.

5. The method as claimed in claim 1, wherein the display is a liquid crystal display.

6. The method as claimed in claim 1, further comprising a step of adjusting the voltage ODV according to an operating temperature.

7. The method as claimed in claim 6, wherein the voltage ODV is inversely proportional to the operating temperature.

8. An apparatus for gray level dynamic switching, applied to drive a display with a pixel, comprising:

a memory set for storing a previous gray level $G_o(t-1)$, $G_o(t-1)$ representing the desired gray level of the pixel at time frame t−1, and $G_o(t-1)$ corresponding to a driving voltage $V_o(t-1)$ to present $G_o(t-1)$ under a static condition;

a processor for determining an optimized driving voltage $V_d(t)$ according to a current gray level $G_o(t)$ and an equation $$V_d(t)=V_o(t-1)+ODV,$$

and determining a dynamic gray level data $G_d(t)$ according to an equation $$V_d(t)=a\times G_d(t)^3+b\times G_d(t)^2+c\times G_d(t)+d,$$

wherein $G_o(t)$ represents the desired level of the pixel at time frame t, the voltage ODV is a minimum voltage capable of obtaining one gray level transition in a determined response time, a is −0.0004, b is 0.0037, c is −0.1443, and d is 8.6992; and a driving circuit for receiving $G_d(t)$ and correspondingly generating the optimized driving voltage $V_d(t)$ to drive the pixel to change the pixel forward to a current state corresponding to $G_o(t)$.

9. The apparatus as claimed in claim 8, wherein, in positive frame, the polarity of the voltage ODV is positive when $G_o(t)>G_o(t-1)$ and negative when $G_o(t)<G_o(t-1)$.

10. The apparatus as claimed in claim 8, wherein, in negative frame, the polarity of the voltage ODV is negative when $G_o(t)>G_o(t-1)$ and positive when $G_o(t)<G_o(t-1)$.

11. The apparatus as claimed in claim 8, wherein the processor further adjusts the voltage ODV according to an operating temperature.

12. The apparatus as claimed in claim 11, wherein the voltage ODV is inversely proportional to the operating temperature.

13. The apparatus as claimed in claim 8, wherein the memory set is a set of dynamic random access memories (DRAM).

14. A display system, comprising:

a display, having at least one pixel;

a memory for storing a program;

a processor for executing, according to a program in the memory, the following steps:

receiving an original gray level sequence $S_o$ consisting of two or more original gray levels $G_o(1), \ldots, G_o(T)$, wherein a current gray level $G_o(t)$ and a previous gray level $G_o(t-1)$ correspond to time frames t and t−1, respectively, and $G_o(t-1)$ corresponds to a driving voltage $V_o(t-1)$ to present $G_o(t-1)$ under a static condition;

transforming $S_o$ to an adjusted gray level sequence $S_d$ consisting of two or more adjusted gray levels $G_d(1), \ldots, G_d(M)$, an adjusted gray level $G_d(m)$ being generated according to a relevant sub-sequence comprising $G_o(t-1)$ and $G_o(t)$, wherein an optimized driving voltage $V_d(t)$ is determined according to the $G_o(t)$ and an equation $$V_d(t)=V_o(t-1)+ODV,$$

and the adjusted gray level $G_d(m)$ is determined according to an equation $$V_d(t)=a\times G_d(m)^3+b\times G_d(m)^2+c\times G_d(m)+d,$$

wherein the voltage ODV is a minimum voltage capable of obtaining one gray level transition in a determined response time, a is −0.0004, b is 0.0037, c is −0.1443, and d is 8.6992; and sequentially driving the pixel with driving forces corresponding to $G_d(1), \ldots, G_d(M)$ in $S_d$.

15. The system as claimed in claim 14, wherein, in positive frame, the polarity of the voltage ODV is positive when $G_o(t)>G_o(t-1)$ and negative when $G_o(t)<G_o(t-1)$.

16. The system as claimed in claim 14, wherein, in negative frame, the polarity of the voltage ODV is negative when $G_o(t)>G_o(t-1)$ and positive when $G_o(t)<G_o(t-1)$.

17. The system as claimed in claim 14, wherein the program in the memory adjusts the voltage ODV according to an operating temperature.

18. The system as claimed in claim 17, wherein the voltage ODV is inversely proportional to the operating temperature.

* * * * *